United States Patent [19]

Doubt

[11] Patent Number: 4,481,081

[45] Date of Patent: Nov. 6, 1984

[54] METHOD FOR BRUSH PLATING CONDUCTIVE PLASTICS

[75] Inventor: Roark M. Doubt, Seattle, Wash.

[73] Assignee: The Boeing Company, Seattle, Wash.

[21] Appl. No.: 537,723

[22] Filed: Sep. 29, 1983

[51] Int. Cl.[3] ..... C25D 5/02; C25D 5/06

[52] U.S. Cl. ..... 204/15; 204/30

[58] Field of Search ..... 204/30, 32 R, 224 R, 204/20, 15

[56] References Cited

U.S. PATENT DOCUMENTS

| | | | |
|---|---|---|---|
| 2,061,592 | 11/1936 | Rapids | 204/224 R |
| 3,755,089 | 8/1973 | Rapids | 204/15 |
| 3,865,697 | 2/1975 | Suggs | 204/224 R |
| 4,035,246 | 7/1977 | Rapids | 204/224 R |

*Primary Examiner*—Thomas Tufariello

*Attorney, Agent, or Firm*—Joan H. Pauly

[57] ABSTRACT

If necessary, initial cleaning of the plastic and masking of areas not to be plated are carried out. Contact points for cathode leads are chosen spaced from the area to be plated. Said area and the contact points are cleaned with a solvent. The contact points are prepared for a brush plating operation. If necessary, this preparation includes an initial abrading of the contact points with fine grit sandpaper. Preferably, the preparation comprises making a cathode lead contact in the area to be plated and brush plating the contact points to about 0.1 mil at a low current density, using an alkaline plating solution. The cathode lead contact is disconnected and the contact points are rinsed. A cathode lead is then connected to each contact point and brush plating of the area to be plated is carried out at a current density sufficiently low to prevent overheating of the plastic, using an alkaline plating solution. Preferably, the brush plating begins at a very low current density until said area is essentially completely covered, and the current density is then increased.

10 Claims, 1 Drawing Figure

METHOD FOR BRUSH PLATING CONDUCTIVE PLASTICS

TECHNICAL FIELD

This invention relates to methods for plating conductive plastics and, more particularly, to such a method that provides good adhesion and complete coverage, that is relatively fast, that is relatively inexpensive to carry out, and that does not require immersion of the part to be plated.

RELATED APPLICATION

This application is related to a companion application of the present applicant, entitled Method For Plating Conductive Plastics, Ser. No. 537,497, filed Sept. 30, 1983.

BACKGROUND ART

In recent years, there has been a steadily increasing interest in the use of composite materials in the aircraft industry. In particular, much effort has been directed toward developing technology for producing and using components made from conductive plastics, such as graphite-reinforced composites. There are a number of situations in which it is desirable to plate a component made from such a composite material. These situations include those in which electronic structures are to be housed inside the composite component and in which it is necessary to protect the electronic structures from electromagnetic intereference and electromagnetic pulses. Other situations in which there is a need for plating a composite component include those situations in which it is desired to ground the component and those situations in which it is desired to provide protection for the component against corrosion or abrasion.

Known methods for applying plating to plastics require immersing the component into a tank of plating solution. Such methods are unsuitable for components that are too large to be immersed and for many components that are assemblies. Immersion of assembly components is generally not acceptable since the solutions tend to collect and remain in the spaces between the parts of the assembly. This can cause corrosion of the parts and could also possibly interfere with the functioning of the component and surrounding components. Immersion of conductive plastic components is also relatively expensive to carry out and requires large quantities of plating solution.

Another problem associated with plating conductive plastics is that it is necessary to use very low current densities to get the process started and lay down the initial layer of plating. The current density must be kept at a very low level because higher current densities would tend to overheat the plastics and thereby damage them. The need to use very low current densities makes the application of conventional brush plating techniques using conventional acid plating solutions impractical if not impossible. At the low current densities required, the acid in the plating solutions consumes the plated copper as rapidly as it is plated. Attempts to speed up the process result in poor adhesion of the plate to the component.

DISCLOSURE OF THE INVENTION

The subject of this invention is a method of plating on conductive plastic. According to an aspect of the invention, the method comprises choosing at least one contact point for a cathode lead spaced not more than about twelve inches from the area to be plated. The area to be plated and the contact point are cleaned with a solvent that will not appreciably attack the plastic. The contact point is then prepared and a cathode lead is connected to the contact point. The area to be plated is brush plated at a current density sufficiently low to prevent overheating of and damage to the plastic, using an alkaline plating solution.

According to another aspect of the invention, the step of preparing the contact point comprises making cathode lead contact in the area to be plated and brush plating the contact point. The contact point is brush plated to about 0.1 mil at a current density sufficiently low to prevent overheating of and damage to the plastic. An alkaline plating solution is used in the brush plating of the contact point. Following the brush plating, the cathode lead contact is disconnected and the contact point is rinsed. When it is necessary to create or improve suitable mechanical bonding sites at the contact point, the step of preparing the contact point preferably further comprises abrading the contact point with fine grit sandpaper before brush plating the contact point.

According to a preferred aspect of the invention, the step of brush plating the area to be plated comprises brush plating at a very low current density until the area to be plated is essentially completely covered, and then increasing the current density and continuing brush plating to at least about 0.2 mil. The initial very low current density ensures that the plastic is protected against excessive heating, and the later increased current density helps to speed up the plating process.

The method of the invention may further comprise the initial steps of cleaning the conductive plastic to remove any surface oil or grease and masking areas not to be plated.

The method of the invention is directed primarily toward providing a method of plating on surfaces that have suitable mechanical bonding sites. For example, the method may be used to plate surfaces of graphite reinforced composites which have been machined through the weave layers of the composite material. If plating that results in only partial coverage is acceptable, such as in situations in which the purpose of the plating is to provide sites for electrical contact, the method of the invention may be used to plate surfaces that do not initially have suitable bonding sites. In such situations, the method of the invention may further comprise abrading the area to be plated by abrasive blasting before brush plating said area. This additional step of abrasive blasting may be used to advantage, for example, for plating as-cast surfaces of a graphite-epoxy composite. With such a composite, the abrasive blasting would serve to remove the surface epoxy layer.

Methods conducted according to the invention have the significant advantage of not requiring any immersion of the component being plated into any sort of solution. Thus, the method of the invention is suitable for plating components too large to be immersed in a tank and for plating assembly components which should not be immersed, and the method is relatively portable. The portability of the method makes it possible for it to be carried out in a variety of locations. For example, an aircraft component may be plated on an airfield without removing the component from the aircraft. Methods conducted according to the invention are relatively easy and inexpensive to carry out and may be completed in a relatively short time. The amount of labor and materials needed are kept at a minimum. In methods conducted according to the invention, it is possible to use brush plating techniques with acceptably low current densities and to obtain good coverage of the area to be plated and good adhesion to such area.

These and other features and advantages will become apparent from the detailed description of the best mode for carrying out the invention that follows.

BEST MODE FOR CARRYING OUT THE INVENTION

Figure 1:
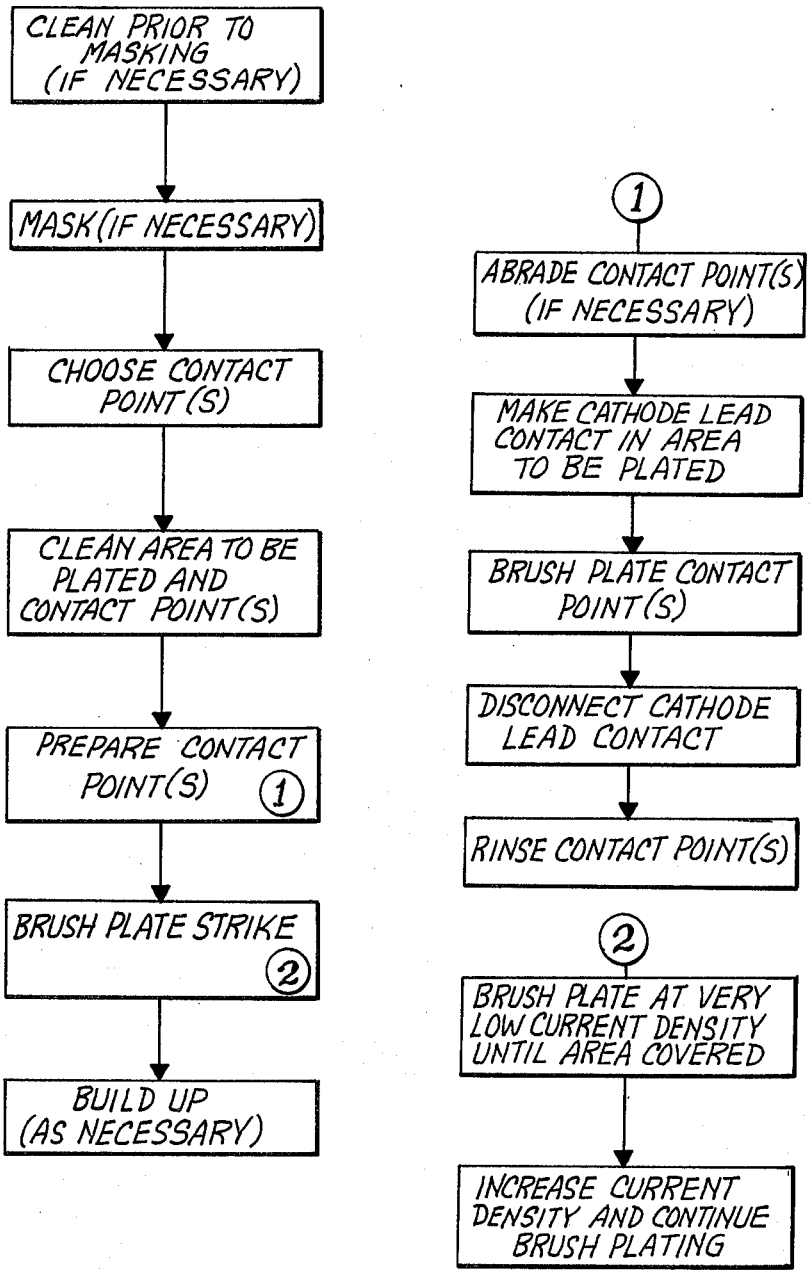
FIG. 1 is a flow chart showing the steps of the preferred embodiment of the invention.

The method of the present invention may be used to great advantage to plate on essentially any conductive plastic, including graphite-reinforced composites. (In this description, the term "conductive plastic" is intended to include both any plastic which is itself conductive and any composite containing a conductive material.) One type of such composites is graphite-reinforced epoxy composites. The following detailed description of the preferred embodiment of the method of the invention is specifically directed toward plating on graphite-reinforced epoxy composites, but it is of course to be understood that the method of the invention may be applied to other types of conductive plastics without departing from the spirit and scope of the invention as defined in the claims.

If the conductive plastic component to be plated is oily or greasy, the first step in the plating process is to clean the surfaces of the component, or at least the surfaces which are to be plated or which must be protected from the plating solution, to remove any surface oil or grease. The cleaning process is preferably done manually using a solvent which does not appreciably attack epoxy. Acceptable solvents include, for example, methyl-ethyl keytone and ethanol. If desired, the initial cleaning process may also be carried out with a hot alkaline cleaning solution which does not appreciably attack the plastic. If the configuration or size of the component makes manual cleaning difficult, flowing or pumping a hot alkaline solution over the surfaces to be cleaned is acceptable. Following the initial cleaning, areas which are not to be plated and which may be exposed to plating solution during the plating process should be masked. Any of a large number of known masking processes may be used. These include using a plater's tape or painting, spraying, or dipping the maskant onto the component.

After carrying out the initial cleaning and masking steps or after determining that these initial steps are unnecessary, one or more contact points for cathode leads are chosen. The contact points should generally be spaced from but within 12 inches of the area to be plated. When the area to be plated is large, multiple or large contact points are necessary. It is generally preferable to select the contact points on a surface that is machined through the weave layers of the composite. If this is not possible or is for some reason undesirable, the contact points may be located on an as-cast surface. In such case, it will be necessary to abrade the contact points, preferably with 180 or finer grit sandpaper, before brush plating the contact points. This abrading provides suitable mechanical bonding sites and electrical contact at the contact points. The contact points should be rinsed with water to remove loose grit following the sanding.

When suitable contact points have been chosen, the area to be plated and the contact point or points are cleaned with a solvent that will not appreciably attack the plastic. When the component being plated is a graphite-reinforced epoxy composite, this cleaning process preferably is carried out manually using a non-epoxy-attacking solvent such as methyl-ethyl keytone or ethanol.

When the area to be plated and the contact point or, points have been cleaned, the contact points are prepared for the brush plating process. If the contact points to not have suitable mechanical bonding sites, the preparation of the contact points includes abrading the contact points to provide suitable bonding sites, as described above, and in such case cleaning the contact points may be omitted. When the contact points have been provided with suitable bonding sites or when it has been determined that such bonding sites already exist, the step of preparing the contact points for the brush plating process proceeds with making cathode lead contact in the area to be plated. With such contact established, the contact points are brush plated to about 0.1 mil at a current density sufficiently low to prevent overheating of and damage to the plastic of the component. For example, when plating on a graphite-reinforced epoxy composite, the brush plating of the contact points would be carried out at approximately 2 volts maximum. The brush plating of the contact points is carried out using known brush plating techniques and using an alkaline plating solution.

As is well-known, brush plating may be accomplished by placing an anode in gauze or some other absorbent material, dipping the absorbent material in plating solution, and applying the solution with the absorbent material directly on the surface to be plated. An example of an alkaline plating solution suitable for use with the method of the invention is the solution manufactured by Selectron, Ltd. of New York, N.Y., and sold under the trademark SPS 5280. When the contact points have been plated to the desired thickness, the cathode lead contact in the area to be plated is disconnected and the contact points are rinsed with water.

After the contact point or points have been prepared, a cathode lead is connected to each contact point and brush plating of the area to be plated is begun. This brush plating is conducted at a current density sufficiently low to prevent overheating of and damage to the plastic. For example, when plating on graphite-reinforced epoxy composites, a voltage of 3 to 4 volts maximum is generally suitable until the area to be plated is well covered. Once the area to be plated is essentially completely covered at this very low current density, the voltage may be increased to about 6 volts and the brush plating continued to a minimum of about 0.2 mil. The use of an initially lower voltage until the area is essentially completely covered provides greater protection against excessive heating of the composite material during the initial stage of the brush plating operation when such protection is most needed. When an initial layer of plating has been placed onto the composite material, the indicated increase in voltage is acceptable and allows the overall process to be accomplished more quickly.

The brush plating of the area to be plated, like the brush plating of the contact points, is carried out using an alkaline plating solution for the strike. As noted above, the use of an alkaline rather than an acid plating solution allows a slow starting of the brush plating process because the problem of the acid in acid plating solutions consuming the copper before the plating process can get started is eliminated. The ability to start the brush plating process very slowly makes it possible to use the very low current densities necessary to protect conductive plastics.

If a greater thickness of plating of the same metal (copper in the case of the Selectron, Ltd. SPS 5280 solution) is desired, the brush plating process may be continued until the desired thickness is reached. If it is desired to plate a different metal on top of the copper, the area to be plated should be rinsed following the plating to 0.2 mil minimum using water. Then the subsequent plating operation may be carried out. During the subsequent plating build-up, the voltage may be increased somewhat but it continues to be necessary to maintain the voltage at a sufficiently low level to avoid excessive heating of the composite material and localized boiling of the plating solution, especially when areas to be plated are less than one square inch. The subsequent build-up may be accomplished by brush plating, flowing the plating solution over the area to be plated, immmersion if not inappropriate, or a combination of these techniques. Once the plating build-up has been completed, the component is rinsed in water and dried.

As noted above, the method of the invention is directed toward plating surfaces which have suitable bonding sites, such as surfaces of graphite-reinforced epoxy composites that have been machined through the weave layers. Such surfaces are provided with essentially complete coverage and good adhesion by use of the method of the invention. If an unmachined surface requires plating but does not require complete coverage, the method of the invention may be used to accomplish the plating. In such case, the method of the invention further comprises abrading the area to be plated by abrasive blasting before cleaning and brush plating said area. The abrasive blasting may be carried out using a variety of materials, including 180 to 240 grit aluminum oxide at 60 to 100 pounds per square inch gauge as necessary to remove the surface epoxy layer. During the abrasive blasting, care must be taken to avoid excessive abrasive blasting which could reduce the gauge of the composite material.

It will be obvious to those skilled in the art to which this invention is addressed that the invention may be used to advantage in a variety of situations. Therefore, it is also to be understood by those skilled in the art that various changes, modifications, and omissions in form and detail may be made without departing from the spirit and scope of the present invention as defined in the following claims.

What is claimed is:

1. A method of plating directly on a surface of conductive plastic, comprising:

choosing at least one contact point on a surface of the plastic for a cathode lead spaced not more than about 12 inches from the area to be plated;

cleaning the area to be plated and the contact point with a solvent that will not appreciably attack the plastic;

preparing the contact point and connecting a cathode lead to the contact point; and brush plating the area to be plated at a current density sufficiently low to prevent overheating of and damage to the plastic, using an alkaline plating solution.

2. A method as described in claim 1, in which the step of preparing the contact point comprises:

making cathode lead contact in the area to be plated;

brush plating the contact point to about 0.1 mil at a current density sufficiently low to prevent overheating of and damage to the plastic, using an alkaline plating solution;

disconnecting the cathode lead contact; and rinsing the contact point.

3. A method as described in claim 2, in which the step of preparing the contact point further comprises abrading the contact point with fine grit sandpaper before brush plating the contact point to provide mechanical bonding sites at the contact point.

4. A method as described in claim 2, in which the plastic is a graphite-reinforced epoxy composite, and the step of brush plating the contact point is carried out at a voltage of about 2 volts maximum.

5. A method as described in claim 1, in which the step of brush plating comprises brush plating at a first current density until the area to be plated is essentially completely covered with an initial layer, said first current density being sufficiently low to prevent overheating of and damage to the plastic when said initial layer is incomplete; and then increasing the current density, but still maintaining it at a sufficiently low level to prevent overheating of and damage to the plastic, and continuing brush plating to at least about 0.2 mil.

6. A method as described in claim 5, in which the plastic is a graphite-reinforced epoxy composite; said initial layer is plated at a voltage of about 3 to 4 volts maximum; and after said initial layer is plated, the voltage is increased to about 6 volts.

7. A method as described in claim 1, further comprising the initial steps of cleaning the conductive plastic to remove any surface oil or grease, and masking areas not to be plated.

8. A method as described in claim 1, in which the plastic is a composite material including a matrix material reinforced with a fibrous conductive material; and which further comprises abrading the area to be plated by abrasive blasting, to remove a surface layer of matrix material, before cleaning and brush plating said area.

9. A method as described in claim 1, in which said alkaline plating solution is a copper solution.

10. A method as described in claim 1, in which said alkaline plating solution is the copper solution sold under the trademark SPS 5280.

* * * * *

UNITED STATES PATENT AND TRADEMARK OFFICE

CERTIFICATE OF CORRECTION

PATENT NO. : 4,481,081

DATED : November 6, 1984

INVENTOR(S) : Roark M. Doubt

It is certified that error appears in the above-identified patent and that said Letters Patent are hereby corrected as shown below:

Column 1, line 31, "intereference" should be --interference--.

Column 4, line 15, "to" should be --do--.

Signed and Sealed this

*Thirtieth* Day of *April 1985*

[SEAL]

*Attest:*

DONALD J. QUIGG

*Attesting Officer* *Acting Commissioner of Patents and Trademarks*